US008339264B2

(12) United States Patent
Yang

(10) Patent No.: US 8,339,264 B2
(45) Date of Patent: Dec. 25, 2012

(54) CONTROL UNIT FOR AN EAS SYSTEM

(76) Inventor: Xiao Hui Yang, Los Altos, CA (US)

( * ) Notice: Subject to any disclaimer, the term of this patent is extended or adjusted under 35 U.S.C. 154(b) by 977 days.

(21) Appl. No.: 12/391,245

(22) Filed: Feb. 23, 2009

(65) Prior Publication Data

US 2010/0052910 A1 Mar. 4, 2010

Related U.S. Application Data

(60) Provisional application No. 61/030,933, filed on Feb. 22, 2008.

(51) Int. Cl.
*G08B 13/14* (2006.01)

(52) U.S. Cl. ..... 340/572.1; 340/10.1; 340/572.7

(58) Field of Classification Search .... 340/572.1–572.8, 340/10.1
See application file for complete search history.

(56) References Cited

U.S. PATENT DOCUMENTS

| | | | | |
|---|---|---|---|---|
| 5,023,600 | A | 6/1991 | Szklany et al. | |
| 5,406,262 | A | 4/1995 | Herman et al. | |
| 5,600,304 | A | 2/1997 | Accolla et al. | |
| 5,627,516 | A | 5/1997 | Balch et al. | |
| 5,737,241 | A | 4/1998 | Accolla et al. | |
| 5,748,085 | A | 5/1998 | Davis et al. | |
| 5,909,178 | A | 6/1999 | Balch et al. | |
| 6,201,469 | B1 | 3/2001 | Balch et al. | |
| 6,320,507 | B1 | 11/2001 | Strzelec et al. | |
| 7,148,804 | B2 * | 12/2006 | Salesky et al. | 340/572.4 |
| 7,212,117 | B2 | 5/2007 | Frederick et al. | |
| 7,474,330 | B2 * | 1/2009 | Wren et al. | 348/150 |
| 7,782,207 | B2 * | 8/2010 | Gillard et al. | 340/572.1 |
| 8,058,994 | B2 * | 11/2011 | Aguirre et al. | 340/572.1 |
| 2004/0155960 | A1 * | 8/2004 | Wren et al. | 348/150 |
| 2005/0046584 | A1 * | 3/2005 | Breed | 340/825.72 |
| 2006/0181395 | A1 | 8/2006 | Gruszynski | |
| 2006/0187042 | A1 | 8/2006 | Romer et al. | |
| 2008/0278320 | A1 | 11/2008 | Soto et al. | |
| 2008/0284593 | A1 | 11/2008 | Soto et al. | |
| 2009/0051534 | A1 * | 2/2009 | Aguirre et al. | 340/572.1 |
| 2009/0174544 | A1 * | 7/2009 | Allen et al. | 340/501 |
| 2009/0322492 | A1 * | 12/2009 | Hannah et al. | 340/10.5 |

* cited by examiner

*Primary Examiner* — Eric M Blount
(74) *Attorney, Agent, or Firm* — Robert R. Waters; Brian W. Foxworthy; Waters Law Group, PLLC

(57) ABSTRACT

A control unit for an EAS system is described, the unit comprising a controller area network (CAN) communication device operatively coupled with a remote communications link. A master control (MC) module interfaces the CAN device and the remote communications link. Machine readable executable instructions reside on a digital signal processor (DSP). The unit further includes at least one system module having a targeted feature within the EAS system.

17 Claims, 1 Drawing Sheet

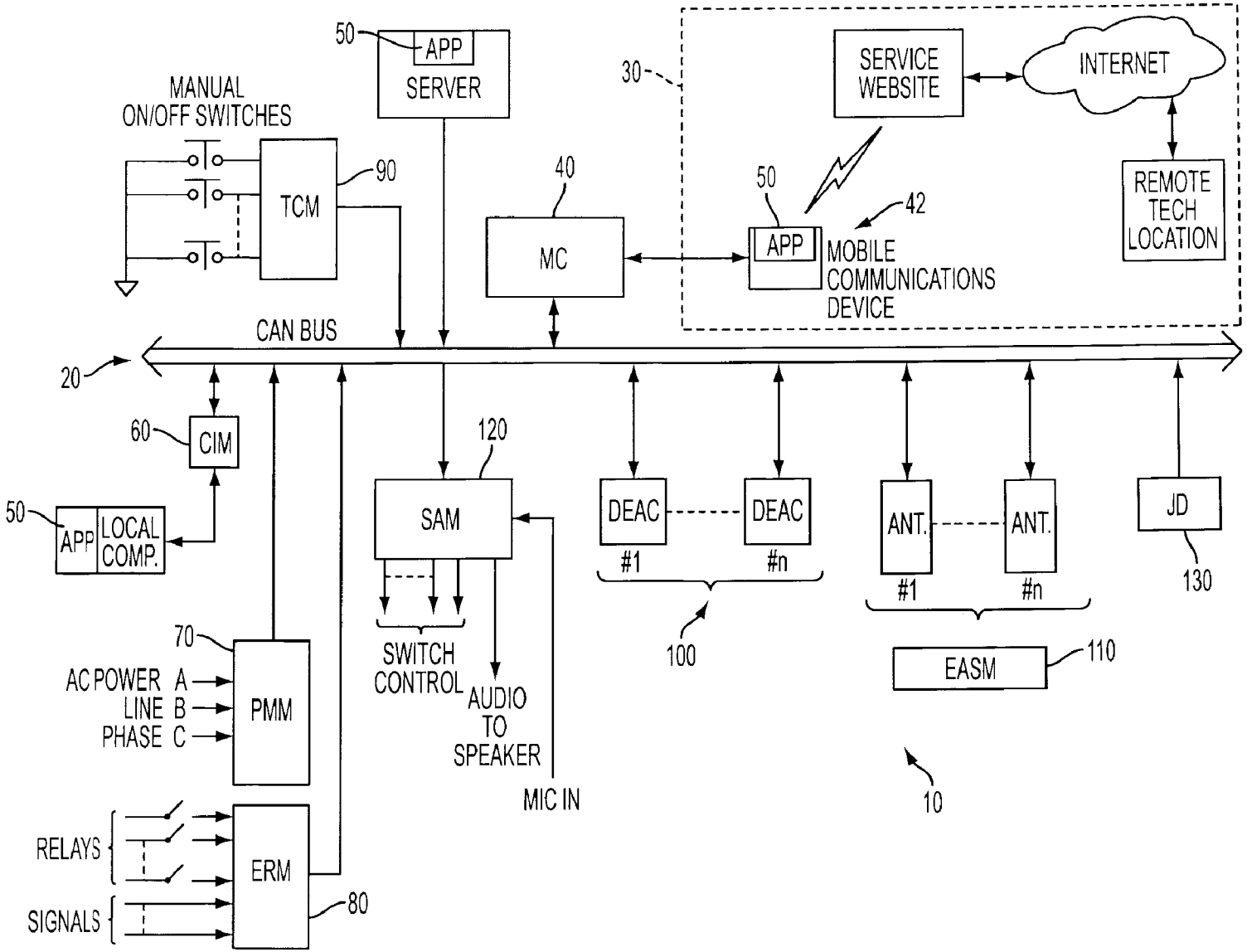
INTERNET
REMOTE TECH LOCATION
SERVICE WEBSITE
42
MOBILE COMMUNICATIONS DEVICE
50
APP
30
40
MC
APP
SERVER
50
90
TCM
MANUAL ON/OFF SWITCHES
CAN BUS
20
CIM
60
LOCAL COMP.
APP
50
JD
130
ANT.
#n
ANT.
#1
110
EASM
10
DEAC
#n
DEAC
#1
100
120
SAM
MIC IN
AUDIO TO SPEAKER
SWITCH CONTROL
PMM
70
AC POWER
A
LINE B
PHASE C
ERM
80
RELAYS
SIGNALS

CONTROL UNIT FOR AN EAS SYSTEM

CROSS REFERENCE TO RELATED APPLICATIONS

This application claims priority from U.S. Provisional Application 61/030,933, filed on Feb. 22, 2008, and the teachings in the specifications for these provisional applications arc incorporated herein by reference.

FIELD OF INVENTION

The present application is generally related to a centralized control unit for an electronic article surveillance (EAS) system, and more specifically, a network based communication device for interfacing with various subsystems and remote communication links including wireless based applications, and interfacing with other systems including access control, environmental monitoring and personnel identity systems.

BACKGROUND

This application includes embodiments and claims pertaining to electronic article surveillance (EAS) systems. Additional embodiments pertain to a control unit integrated with an EAS system for analyzing and monitoring various functions within the EAS system.

Theft or shoplifting is a common concern or problem in retail establishments. Several techniques and systems have been developed to address this problem. Generally, an electronic transponder is attached to goods in the retail establishment and detection systems are placed at the exits of the establishment to detect whether a transponder is being removed from the establishment. The systems at the exits comprise transmitting and receiving antennas and controls for those antennas. A transmitting antenna monitors an area by broadcasting an interrogation field into it. When this interrogation field ceases, transponders that are located within the area respond with a signal and receiving antennas are tuned to detect these signals.

The transponders may be of several types, including harmonic transponders and resonant transponders. The interrogation signal of the transmitter antenna causes a small amount of energy to be stored on the transponders, and this energy dissipates after the interrogation signal stops, generating a signal that is recognized by the system. Typically, these systems are set up by installation technicians and the retail locations operating these systems have only a minimal level of control over the operation of the systems. If a system is displaying a consistent alarm, which may be a false alarm, or if the system appears to be experiencing a jamming signal, or if the environment within the store causes system alarms to be inappropriately loud or ineffectively quiet, the operators at the retail establishments have little ability to cope with the changes. Moreover, as shoplifters become more and more sophisticated, retailers begin to experience more issues with jamming devices, espionage and targeted attacks on the integrity of EAS systems and access control systems. All of these factors make it very important that a retailer has the capability of integrating security subsystems to augment a holistic security program within the establishment.

SUMMARY

In one embodiment, a control unit for an EAS system is described, the unit comprising a controller area network (CAN) communication device operatively coupled with a remote communications link. A master control (MC) module interfaces the CAN device and the remote communications link. Machine readable executable instructions reside on a digital signal processor (DSP). The unit further includes at least one system module having a targeted feature within the EAS system.

In another embodiment, a control unit for an EAS system is disclosed, the unit comprising a controller area network (CAN) communication device operatively coupled with a remote communications link. A master control (MC) module interfaces the CAN device and the remote communications link. Machine readable executable instructions residing on a digital signal processor (DSP) interconnect with the CAN communication device. The unit may further include optionally one or more of a computer interface module (CIM), and a transmit control module (TCM), a deactivator module (DEACM), and/or an EAS module (EASM).

The control unit may further comprise one or more of a security action module (SAM), a power monitor module (PMM), an external relay module (ERM).

The "Summary" is provided merely to introduce certain concepts. The "Summary" is not intended to identify any key or essential feature of the claimed subject matter.

DESCRIPTION OF THE EMBODIMENT(S)

Referring to FIG. 1, a control unit for an electronic article surveillance (EAS) system is schematically depicted. In one embodiment of the system, the control unit 10 comprises a controller area network (CAN) communication device 20 providing the internal communication medium for the unit 10. The CAN device 20 may be a serial bus that is used in distributed real-time control systems for embedded control over one or more microcontrollers operatively communicating within the unit 10. The microcontrollers generally comprise one or more devices, sensors, actuators and/or interrelated hardware and/or software applications providing real-time control over the system or sub-systems linked therein. Herein, and described in more detail below, the microcontrollers are identified as separate modules. The unit 10 further includes a remote communications link 30 for remote communication of input or output, including information, data, commands and/or responses.

All the devices, sensors, actuators and/or hardware or software are available and accessible to the CAN bus through a combination of specialized modules and a CAN bus converter. Application software in the form of machine readable executable instruction(s) residing on and operating on a digital signal processor (DSP) monitors and supervises the CAN device 20 bus and attendant devices interconnected with the CAN device 20 bus. The remote communications link 30 permits external communication between the control unit 10 and a mobile communications device 42 operating compatible application software.

In one embodiment, one or more modules may be provided to control and/or transmit information, data and/or commands from, to and between devices, sensors, actuators and application software interconnected within the control unit 10. The separate modules provide a plurality of functions, and includes monitoring of EAS product integrity, switches, alarms, digital signals, label deactivators, EAS detection system(s), as well as activation of devices such as audio and/or visual alarms or recording devices, data recording devices, door locks, push messages and other auxiliary output devices. The integration of the plurality of modules within the control unit 10 provides a dynamic and responsive mechanism for monitoring, adjusting, and/or troubleshooting EAS products in real-time.

In one embodiment, the control unit 10 comprises a master controller module (MC) 40 that serves as the master control device for all control unit 10 functions over and through the CAN device 20 bus. The MC 40 processes information transmitted by the various modules, devices, sensors, actuators and applications interconnected with the CAN device 20 bus. The MC 40 interfaces with any mobile communication device (generally denoted by reference character 42) operatively coupled for dynamic communication of the EAS system on-site or remotely. By interfacing with the mobile communication device 42, the MC 40 provides real-time status information and processes inputs and commands as performed by the operator of the device 42.

The control unit 10 may further include application software in the form of machine readable executable instruction(s) (APPS) and generally denoted by reference character 50. The APPS 50 may comprise a plurality of modules or sub-modules residing in different space(s) and linked or intercommunicating by or through different medium(ia). For example, as but one example, one or more segments of APPS 50 may reside within the control unit 10 to control performance of local operations of the control unit 10 and modules. A second segment of APPS 50 may reside in the mobile communication device 42 to facilitate remote monitoring and control of the various devices and/or modules interconnected with the control unit 10. A third segment of APPS 50 may reside on a server, on-site or remote, accessible over the Internet. In this example, the third segment of APPS 50 may wirelessly interface with the mobile communications device 42.

The control unit 10 may further include a computer interface module (CIM) 60. The CIM 60 is the communications link between various computing modules and a host. For example, one or more general purpose computers and one or more special purpose computers may be provided on-site, wherein the CIM 60 interfaces between the computers and the CAN device 20 bus. A general purpose computer is one that generally follows executable instructions; a special purpose computer is one designed to address a specific problem or issue. General purpose computers may include desktop and laptop computers, portable communication devices, including handheld units, and the like.

The control unit 10 may further include a power monitor module (PMM) 70. The PMM 70 monitors all phases of the AC power line, such as the lines A, B and C depicted in FIG. 1. Digital information is transmitted to the DSP over the CAN device 20 bus, allowing a technician to ascertain if excessive noise exists on the AC power line and if there is a phasing issue between the EAS systems that may be causing one or more malfunctions. The PMM 70 ascertains noise pollution or interference inherent in the EAS system or that is introduced by other devices utilizing the AC power line.

It is also envisioned that the control unit 10 may further include an external relay module (ERM) 80 that monitors external signals interconnected with the EAS system. For example, the ERM 80 may include or incorporate items such as door relays, window relays, smoke or other environmental detectors, counters and other similar devices or apparatuses. These devices or apparatuses generate and transmit one or more signals. When one or more active signals is received, the ERM 80 transfers the information to the DSP over the CAN device 20 bus. The ERM 80 monitors the external devices and apparatuses and then communicates the respective status of the devices through the CAN device 20 bus. In response, the ERM 80 may activate or command additional responses from other devices within the CAN device 20 bus network, generally controlled through the APPS 50. For example, the ERM 80 may include a door relay or detector that is set for operable detection for post-operational hours of the facility. If the door relay or detector is triggered by an unauthorized entry, the relay or detector transmits a signal to the ERM 80 that is transferred to the DSP for activating an alarm. One example of activation may include the use of one or more audio or visual alarms transmit to proper personnel, including off-site security management. The activation may also include the utilization of one or more recording media for memorializing the event, such as analog or digital recording of selected facility areas.

It is also envisioned that the control unit 10 may further include a transmit control module (TCM) 90. The TCM 90 may comprise one or more manually operated toggle switches. At least one of the switches may selectively activate and deactivate the operation of the transmitter portion of the EAS system. In providing such a switch, a technician, operator or other authorized personnel may perform a diagnostic review or manual inspection of the system for tag pollution.

For example, it is a known problem that EAS systems will sometimes persistently stay in alarm status, generally labeled as a false alarm. Staying in alarm status prevents an EAS system from functioning as it should, because there is no effective way for individuals operating the system to know whether or not a transponder is actually present or if the system is malfunctioning. One possibility is that the system needs to be tuned. Another possibility is that there is a tag somewhere that is in the systems interrogation zone.

Frequently, when a technician is called in to diagnose a system persistently staying in alarm status, the cause of the false alarming is found to be a transponder located in the interrogation zone. Simply finding it and removing it resolves the reported problem, and a trained technician is not needed to accomplish this. Many times, unfortunately, to determine that the problem is the presence of a transponder in the interrogation zone, a costly service call by a service technician is required.

One embodiment may include a manual switch to turn the transmitter antenna off/on. If the system appears to false alarm, the user flips the switch to turn off the transmitter. If the system continues to alarm, then there is a high probability that the system requires adjustment or other repair action, because the transmitter is no longer generating an interrogation field, but the system is still indicating that a response from a transponder is being detected. If the system stops alarming, then there is a high probability that there is a security tag, or transponder, somewhere in the interrogation zone. If a user determines that the persistent alarm is being caused by the presence of a security tag, the user can turn the transmitter back on and search the area for a tag, or begin moving tagged articles away from the system until it stops alarming. This only takes a few minutes, can be accomplished by on site personnel and saves a costly call to a service technician.

The control unit 10 may further comprise a deactivator module (DEACM) 100. The DEACM 100 serves as an interface between the label or tag deactivators at point of sale (POS) and the CAN device 20 bus. The DEACM 100 interface transmits information and data for one or more deactivators placed in the facility. Such information or data may include the tuning of the deactivator unit(s), and a corresponding signal to properly tune the deactivator unit(s) for proper operation of the device. Another type of information or data may include the serial recording of items deactivated, along with a time stamp, cashier position, and other similar data that may be useful to the vendor.

The control unit 10 may further include an EAS module (EASM) 110. The EASM 110 serves as an interface between the EAS system and the CAN device 20 bus. One embodiment includes the interface of one or more EAS antennae or detectors installed beyond the POS, including but not limited to installation at one or more exits of the facility. Information and data may be transmitted between the antennae and the various devices within the control unit 10. The antennae may be monitored, adjusted and/or troubleshot for other issues as necessary. The EASM 110 may also incorporate one or more aspects of the DEACM 100 feature(s) described above, such as monitoring and/or tuning of the deactivators at the POS.

The control unit 10 may further comprise a security action module (SAM) 120. The SAM 120 is envisioned to include one or more auxiliary outputs to activate alarms, lights, locks or other security devices or apparatuses, in combination or sub-combinations thereof. The SAM 120 may also be utilized for providing pre-recorded messages or instructions as input according to pre-defined parameters or conditions. For example, a specific alarm activation may induce generation of a pre-recorded message transmitted by audible means to instruct facility personnel to follow a specific protocol or procedure.

The control unit 10 may further include a jamming detector (JD) 130 that detects a jamming signal from a foreign device intended to disable or overwhelm the EAS system. The purpose of EAS systems is to thwart thieves in retail and other settings. In response to the widespread use of EAS systems, thieves have adapted in various ways. Some have developed hand-held devices that overdrive EAS systems, creating large amount of noise at different bandwidths to "jam" the system, disabling the system and preventing it from detecting tags as they enter their interrogation zone. The extreme amount of noise, in the interrogation zone prevents the EAS system from discerning the weaker responses from tags passing through the interrogation field.

One embodiment monitors the system for extreme noise levels in several bandwidths to detect or recognize the jamming signal and generate a user selectable alarm or output a signal to an external alarm generator. This serves to automatically alert employees that someone is attempting to disable the EAS system detection capability. The variety of alarm options discussed with regard to the embodiments below can also be provided by the multi-function control box with regard to the jamming detection functions of the present embodiments.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims arc based may be readily utilized as a basis for the design of other structures, methods, and systems. In addition, it is to be understood that the phraseology and terminology employed herein are for the purposes of description and should not be regarded as limiting the claims.

Furthermore, the Abstract is neither intended to define the claims of the application, nor is it intended to be limiting to the scope of the claims in any way. It is intended that the application is defined by the claimed appended hereto.

What is claimed is:

1. A control unit for an EAS system, the unit comprising:
a controller area network (CAN) communication device;
a remote communications link;
a master control (MC) module;
machine readable executable instructions residing on a digital signal processor (DSP); and,
at least one system module, said at least one system module comprising communication between the MC module and at least one AC power line monitoring device.

2. The unit of claim 1, wherein the remote communications link comprises a POP3/SMTP protocol.

3. The unit of claim 1, wherein the at least one system module comprises communication between the MC module and at least one tag or label deactivation device.

4. The unit of claim 3, wherein the communication between the at least one system module and the MC module transfers tuning information about the deactivation device.

5. The unit of claim 3, wherein the communication between the at least one system module and the MC module transfers deactivation quantity information.

6. The unit of claim 1, wherein the at least one system module comprises communication between the MC module and at least one antenna of the EAS system.

7. The unit of claim 6, wherein the communication between the at least one system module and the MC module transfers deactivation information.

8. The unit of claim 1, wherein the at least one system module comprises at least one manual switch for activating and deactivating the EAS system.

9. The unit of claim 1, wherein the at least one system module comprises an interface between at least one computer and the CAN communication device.

10. The unit of claim 1, wherein the at least one system module comprises communication between the MC module and at least one security device.

11. The unit of claim 1, wherein the at least one system module comprises communication between the MC module and at least one relay.

12. A control unit for an EAS system, the unit comprising:
a controller area network (CAN) communication device
a remote communications link;
a master control module;
machine readable executable instructions residing on a digital signal processor (DSP) interconnected with the CAN communication device;
a computer interface module (CIM);
a transmit control module (TCM);
a deactivator module (DEACM);
an EAS module (EASM); and,
a power monitor module (PMM).

13. The unit of claim 12 further comprising a security action module (SAM).

14. The unit of claim 13, wherein the SAM further comprises at least one audio or visual alarm device.

15. The unit of claim 12 the PMM further comprising at least one AC power line phase monitoring device.

16. The unit of claim 12 further comprising an external relay module (ERM).

17. The unit of claim 16 the ERM further comprising at least one external relay operatively communicating ingress or egress to an area.

* * * * *